US005895116A

United States Patent [19]

Kreinheder et al.

[11] Patent Number: 5,895,116

[45] Date of Patent: Apr. 20, 1999

[54] MOBILE ADMIXTURE PRODUCT MANUFACTURING AND DELIVERY PROCESS AND SYSTEM

[75] Inventors: Mark Kreinheder, Long Beach, Calif.; Thomas Shea, Kensington, N.H.

[73] Assignee: W.R. Grace & Co. -Conn., New York, N.Y.

[21] Appl. No.: 08/918,271

[22] Filed: Aug. 25, 1997

[51] Int. Cl.[6] ..... B28C 7/04

[52] U.S. Cl. ..... 366/8; 366/17; 366/142

[58] Field of Search ..... 366/3, 8, 10, 16, 366/17, 18, 19, 20, 21, 42, 43, 53, 62, 63, 140, 150.1, 151.1, 142

[56] References Cited

U.S. PATENT DOCUMENTS

| | | | |
|---|---|---|---|
| 2,934,102 | 4/1960 | Martin | 141/21 |
| 4,298,288 | 11/1981 | Weisbrod | 366/16 |
| 4,406,548 | 9/1983 | Haws | 366/8 |
| 4,457,660 | 7/1984 | Pippinger | 414/332 |
| 4,553,573 | 11/1985 | McGarrah | 141/98 |
| 4,686,852 | 8/1987 | Ito et al. | 366/140 |
| 4,792,234 | 12/1988 | Doherty | 366/18 |
| 4,896,968 | 1/1990 | Baillie | 366/140 |
| 4,911,330 | 3/1990 | Vlaanderen et al. | 222/132 |
| 5,018,645 | 5/1991 | Zinsmeyer | 222/14 |
| 5,044,819 | 9/1991 | Kilheffer et al. | 366/8 |
| 5,171,121 | 12/1992 | Smith et al. | 414/332 |
| 5,203,629 | 4/1993 | Valle et al. | 366/2 |
| 5,785,421 | 7/1998 | Milek | 366/16 |

OTHER PUBLICATIONS

ASTM Standards, Standard Specification for Ready–Mixed Concrete, 10 pages, May, 1994.

*Primary Examiner*—Tony G. Soohoo
*Attorney, Agent, or Firm*—Craig K. Leon; William L. Baker

[57] ABSTRACT

A mobile system and process for manufacturing and delivering concrete admixture finished products comprises: providing in separate transport tanks mounted on a vehicular frame at least two raw admixture materials (components); and blending together said at least two concrete admixture raw materials to provide a finished admixture product, whereby a finished admixture product is provided at a customer site, such as at a customer's mixing plant. Preferred processes and systems of the invention employ pump means for feeding admixture raw materials from the transport tanks to a blender, metering means for measuring the amount or rate of raw materials fed into the blender, and quality control units for monitoring physical characteristics of the finished product being delivered. Quality control units, such as devices for measuring certain physical properties such as total solids, specific gravity, pH, viscosity, volume, or other properties, may be employed to monitor, control, and track the nature of finished admixture product as they are made and/or dispensed, and even of the individual raw material components being processed in the system.

32 Claims, 1 Drawing Sheet

MOBILE ADMIXTURE PRODUCT MANUFACTURING AND DELIVERY PROCESS AND SYSTEM

FIELD OF THE INVENTION

The present invention relates to the field of concrete additives useful in modifying the properties of concrete, and more particularly to a mobile admixture product manufacturing and delivery process and system involving the metering and mixing of concrete admixture raw materials to provide finished admixture product at customer sites.

BACKGROUND OF THE INVENTION

As known in the art, an "admixture" is a material other than hydraulic cement, water, and aggregates used as an ingredient of concrete or mortar and added to the batch immediately before and during its mixing. Admixtures are used for modifying one or more properties of the concrete in such a way as to make it more suitable for a particular purpose or for economy.

Some of the major reasons for using admixtures are (1) to achieve certain structural improvements in the resulting cured concrete; (2) to improve the quality of concrete through the successive stages of mixing, transporting, placing, and curing during adverse weather or traffic conditions; (3) to overcome certain emergencies during concreting operations; and (4) to reduce the cost of concrete construction. In some instances, the desired result can only be achieved by the use of an admixture. In addition, using an admixture allows the use of less expensive construction methods or designs and thereby offsets the costs of the admixture.

Typically, admixtures are sold as a "finished product" or "finished admixture product" which is shipped in a tanker truck that may have a number of compartments containing other finished admixture products. The terms "finished product" and "finished admixture product" mean that the admixture is comprised of a "raw material" component, such as lignin, corn syrup, an amine, etc. which is either mixed with water and/or another raw material.

SUMMARY OF THE INVENTION

The present invention provides a novel process and system for manufacturing finished concrete admixture products, from raw materials transported on a vehicular frame such as a truck or trailer, at the customer site. The invention allows a concete admixture manufacturer to custom blend at the point of delivery to the customer. An admixture manufacturer can test and adjust the finished admixture product at the customer site, based on customer control needs, quality control data, or other factors. The invention permits monitoring of physical characteristics of finished admixture product, such as total solids, viscosity, specific gravity, pH, and other characteristics, and permits adjustments to be made, if needed, at the time of delivery.

An exemplary process of the invention for manufacturing concrete admixture products comprises providing in separate transport tanks mounted on a vehicular frame, such as a truck or trailer, at least two admixture raw materials; transporting said at least two admixture raw materials; blending together said at least two raw materials, preferably by using a blender mounted on the vehicular frame, to provide a finished admixture product; and dispensing the finished admixture product. Preferably, one of more quality control units, such as devices for measuring total solids, viscosity, pH, specific gravity, or other physical properties, can be mounted on the vehicular frame, so that the finished admixture product or any of the raw admixture materials can be monitored or adjusted.

Another exemplary system and process of the invention comprises using a central processing unit, such as a laptop and/or hand held unit, which is in electronic communication with the valving/pumping means, the blender, and one or more of the quality control units, to provide monitoring of physical characteristics of the finished admixture product or raw materials. These can take place at the site of customer delivery to permit the finished admixture product to be adjusted or modified.

Other advantages and features of the inventive process and system of the invention will be further described hereinafter.

BRIEF DESCRIPTION OF THE DRAWINGS

A better comprehension of the following detailed description of exemplary embodiments of the present invention may be facilitated by reference to the appended drawing, wherein.

DETAILED DESCRIPTION OF EXEMPLARY EMBODIMENTS

Figure 1:
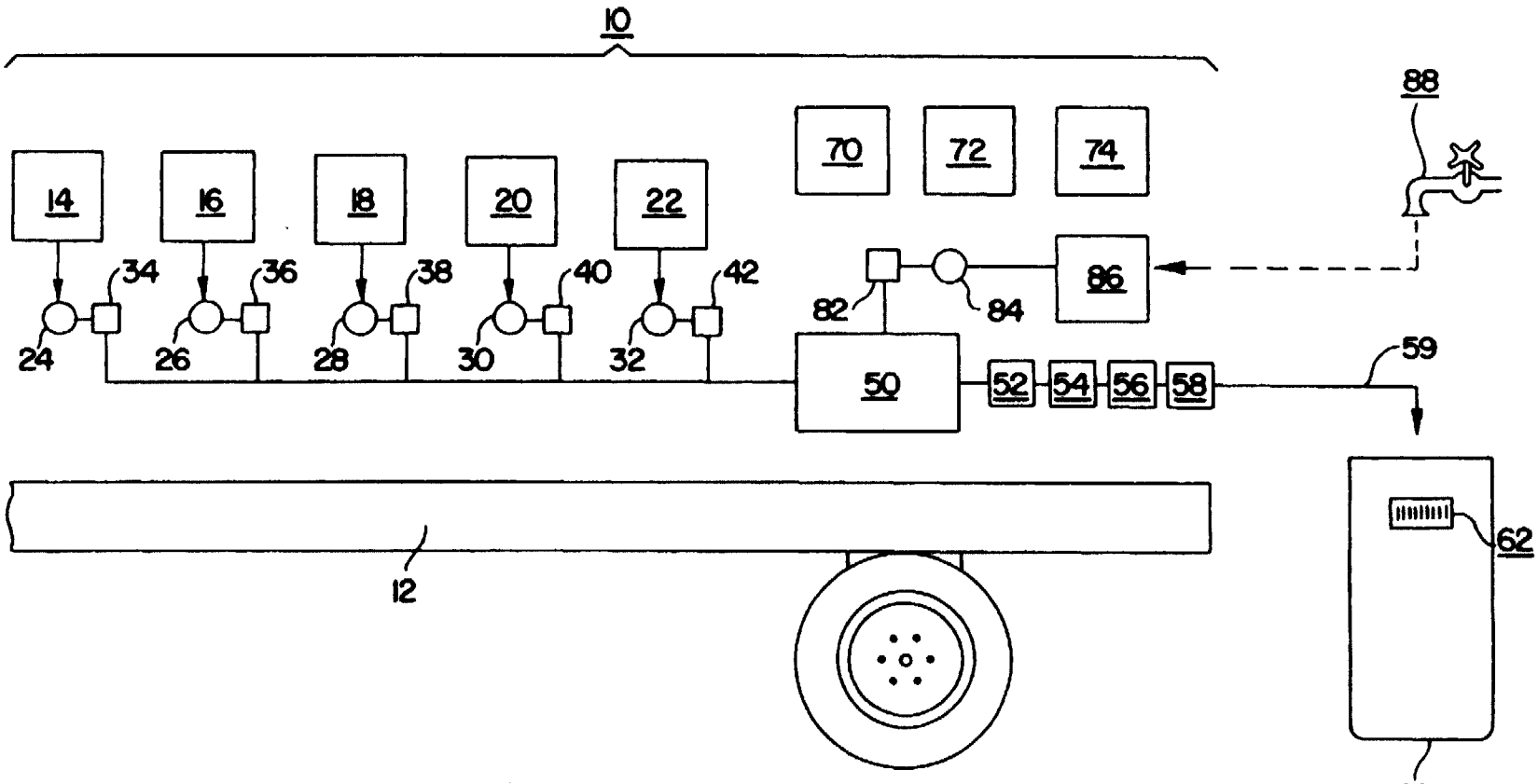
FIG. 1 is a schematic diagram of an exemplary mobile manufacturing system and process of the present invention for transporting, metering, mixing, monitoring, and dispensing concrete admixture products at a customer's site.

As shown in FIG. 1, an exemplary process and system 10 of the present invention comprises providing on a vehicular frame 12, such as a truck, trailer, or other mobile platform structure, two or more separate transport tanks, designated at 14, 16, 18, 20, and 22, containing at least two concrete admixture raw materials, which are preferably provided in a liquid flowable form, in contrast to a dry particulate solid form.

As mentioned above, a "raw material" is combined with water and/or another raw material to provide a finished admixture product. Raw materials are known in the concrete admixture industry. For purposes of the present invention, exemplary raw materials include molasses, sulfonates (e.g., melamine sulfonate, maphthalene sulfonate), calcium chloride, amines and alkanolamines, tall oil fatty acids, fatty acids and their derivatives, fatty esters and their derivatives, sodium gluconate, dyes, formic acid, sucrose, sugars, glucose, sodium nitrite, sodium nitrate and calcium nitrite and calcium nitrate (e.g., for making into solutions), calcium bromide, corn syrup, sodium sarcosinate, calcium lignosulfonate, lignin, alcohols (e.g., glycols and glycerols), acetic acid, anhydrous caustic soda, sodium hydroxide, potassium hydroxide, sodium linear alkylate sulfonate, formaldehyde, silica, a diglycinate, polymers containing oxyalkylene, calcium formate, formic acid, siloxanes, surfactants, resins and resin acids, and mixtures and derivatives of any of the foregoing. It is contemplated that the transport tanks 14, 16, 18, 20, and 22 can be used for transporting and delivering at least two different raw materials, and preferably 4–6 or more different raw materials, all of which can be blended with water and/or each other at the customer's site.

A raw material component, such as one of the materials listed above, can be combined with water and/or another raw material component to provide a finished admixture product. Thus, for example, an illustrative water reducing admixture in the form of a "finished admixture product" can be manufactured by combining lignin, corn syrup, an amine, and water. Another finished product may involve an adjustment in the concentrations of the various components; or additional materials, such as a surfactant and/or a biocide; or may involve substracting a component.

There may be some infrequent instances in which a raw material (e.g., calcium nitrite) can be dispensed directly into a holding tank at the customer site without to having to be adjusted or diluted by addition of water or without being combined with another raw material. However, this does not mean that a directly added material is thus not a "raw material" for purposes of the present invention.

In preferred embodiments, valve and/or pumping devices, such as designated at 24, 26, 28, 30, and 32, are provided for feeding raw materials into a blender 50, such as a static rotor mixer, where they can be thoroughly mixed before being dispensed as final admixture product into the customer's tank 60. In further preferred embodiments, at least one quality control unit, such as a total solids measuring device 52, pH measuring device 54, viscosity measuring device 56, and/or specific gravity measuring device 58, are employed for ascertaining, determining, measuring, and/or confirming physical characteristics of the final admixture product or one or more raw materials. Final admixture product can be thus checked before or after being dispensed into the customer's holding tank 60. A pipe or hose 59, which preferably has a kill-switch connected to the blender 50 or valve or pump (not shown) leading from the blender 50, can be used to dispense admixture raw materials or admixture products at the customer site.

Concrete admixtures are often classified by function, and it may help to provide a brief discussion of admixture categories and the kinds of materials which are often used as the raw material components in these categories (which is provided in large part in U.S. Pat. No. 5,203,629 of Valle et al., incorporated by reference herein) as follows:

Accelerators are used to accelerate the setting and early strength development of concrete. Some of the common materials that can be used to achieve this function are calcium chloride, triethanolamine, sodium thiocyanate, calcium formate, calcium nitrate, and calcium nitrite.

Retarding, or delayed-setting, admixtures are used to retard, delay, or slow the rate of setting of concrete. Retarders are used to offset the accelerating effect of hot weather on the setting of concrete, or to delay the initial set of concrete or grout when difficult conditions of placement occur, or when problems of delivery to the construction site arise, or when time is needed for special finishing processes. Most retarders also act as water reducers and can also be used to entrain some air into concrete. Lignosulfonates, hydroxylated carboxylic acids, lignin, borax, gluconic, tartaric, and other organic acids and their corresponding salts, and certain carbohydrates can be used as retarding admixtures. Sodium gluconate, manufactured under the brand RECOVER® is available from W. R. Grace & Co.—Conn. is a preferred set retarder.

Air detrainers are used to decrease the air content in the concrete mixture. is Tributyl phosphate, dibutyl phthalate, octyl alcohol, water-insoluble esters of carbonic and boric acid, and silicones are some of the common materials that can be used to achieve this effect.

Air-entraining admixtures are used to purposely entrain microscopic air bubbles into concrete. Air-entrainment dramatically improves the durability of concrete exposed to moisture during cycles of freezing and thawing. In addition, entrained air greatly improves a concrete's resistance to surface scaling caused by chemical deicers. Air entrainment also increases the workability of fresh concrete while eliminating or reducing segregation and bleeding. Materials used to achieve these desired effects can be selected from salts of wood resin; (Vinsol resin); some synthetic detergents; salts of sulfonated lignin; salts of petroleum acids; salts proteinaceous material; fatty and resinous acids and their salts; alkylbenzene sulfonates; and salts of sulfonated hydrocarbons.

Alkali-reactivity reducers can reduce alkali-aggregate expansion of these reducers, and include pozzolans (fly ash, silica fume), blast-furnace slag, salts of lithium and barium, and other air-entraining agents are especially effective.

Bonding admixtures are usually added to portland cement mixtures to increase the bond strength between old and new concrete and include organic materials such as rubber, polyvinyl chloride, polyvinyl acetate, acrylics, styrene butadiene copolymers, and other polymers.

Water-reducing admixtures are used to reduce the amount of mixing water required to produce concrete of a certain slump, to reduce the ration of water and cement, or to increase slump. Typically, water reducers will reduce the water content of the concrete mixture by approximately 5% to 10%. (See Water Reducing admixtures discussed above).

Superplasticizers are high-range water reducers, or water-reducing admixtures. They are added to concrete to make high-slump flowing concrete, thus reducing the water-cement ratio. These admixtures produce large water reduction or great flowability without causing undue set retardation or entrainment of air in mortar or concrete. Among the materials that can be used as superplasticizers are sulfonated malamine formaldehyde condensates, sulfonated naphtalane formaldehyde condensates, certain organic acids, lignosulfonates, and blends thereof. Superplasticizers may also include polyacrylic acid polymers having oxyalkylene groups are especially preferred, and are commercially available from W. R. Grace & Co.—Conn. under the tradename ADVA™.

Colorants may be natural or synthetic in nature, and can be used for coloring concrete for aesthetic and safety reasons. These coloring admixtures are usually composed of pigments and include carbon black, iron oxide, phthalocyane, umber, chromium oxide, titanium oxide, and cobalt blue.

Corrosion inhibitors in concrete serve to protect embedded reinforcing steel from corrosion due to its highly alkaline nature. The high alkaline nature of the concrete causes a passive and noncorroding protective oxide film to form on the steel. However, carbonation or the presence of chloride ions from deicers or seawater can destroy or penetrate the film and result in corrosion. Corrosion-inhibiting admixtures chemically arrest this corrosion reaction. The materials most commonly used to inhibit corrosion are calcium nitrite, sodium nitrite, sodium benzoate, certain phosphate; or fluoroaluminates, and fluorosilicates.

Dampproofing admixtures reduce the permeability of concrete that have low cement contents, high water-cement ratios, or a deficiency of fines in the aggregate. These admixtures retard moisture penetration into dry concrete and include certain soaps, stearates, and petrolium products.

Gas formers, or gas-forming agents, are sometimes added to concrete and grout in very small quantities to cause a slight expansion prior to hardening. The amount of expansion is dependent upon the amount of gas-forming material used, the temperature of the fresh mixture. Aluminum powder, resin soap, and vegetable or animal glue, saponin or hydrolyzed protein can be used as gas formers.

Permeability reducers are used to reduce the rate at which water under pressure is transmitted through concrete. Silica fume, fly ash, ground slag, natural pozzolan water reducers, and latex can be employed to decrease the permeability of the concrete. Pozzolan is a siliceous or siliceous and aluminous material, which in itself possesses little or no cementitious value. However, in finely divided form and in the presence of moisture, Pozzolan will chemically react with calcium hydroxide at ordinary temperatures to form compounds possessing cementitious properties.

Pumping aids are added to concrete mixed to improve pumpability. These admixtures thicken the fluid concrete, i.e., increase its viscosity, to reduce de-watering of the paste while it is under pressure from the pump. Among the materials used as pumping aids in concrete are organic and synthetic polymers, hydroxyethylcellulose (HEC) or HEC blended with dispersants, organic flocculents, organic emulsions of paraffin, coal tar, asphalt, acrylics, bentonite and pyrogenic silicas, natural pozzolans, fly ash and hydrated lime.

Bacterial and fungal growth on or in hardened concrete may be partially controlled through the use of fungicidal, germicidal, and insecticidal admixtures (which may otherwise be altogether termed "biocidal" admixtures). The most effective materials for these purposes are polyhalogenated phenols, dieldrin emulsions, and copper compounds.

It is further contemplated that all known raw materials and finished admixture products may be used in the manufacturing process and system of the present invention, preferably in their liquid. Thus, further exemplary systems and processes of the invention involve the use of water (represented by the faucet at 88) sourced at the customer site, to adjust raw materials or finished product. Accordingly, a valving/pump 82 device and/or metering device 84, and preferably an on-board water holding tank 86, is provided on the truck for the purposes of allowing water 88 to be added (preferably at a controlled, monitored rate/amount) into the blender 50, to be combined with one or more raw materials, and/or to permit raw materials in the transport tanks or in the blender, or finished admixture product, to be adjusted or modified, e.g., such that desired total solids, viscosity, pH, specific gravity, volume, and/or other physical characteristics can be provided according to a given customer's job specification or profile.

An exemplary process (as illustrated in FIG. 1) for manufacturing finished concrete admixture product at a customer site comprises providing in separate transport tanks (.e.g, 14, 16, and 18) mounted on a vehicular frame (12) at least two concrete admixture raw materials (and more preferably at least four raw materials); transporting the at least two concrete admixture raw materials to a customer site 60 on said vehicular frame 12; blending together the at least two concrete admixture raw materials; and dispensing a finished concrete admixture product into a holding tank 60 located at said customer site.

In other exemplary processes, one or more concrete admixture raw materials are metered (using pumps or metering devices) into a blender (e.g., static mixer) 50 which blends the raw materials together to provide a final admixture product in accordance with the customer's order. Preferably, a central processing unit ("CPU") 70, which is mounted on the vehicular frame (truck or trialer), or which is provided in the form of a "laptop" computer and/or a hand-held computer (e.g., such as that available under the "NORAND" trademark is electronically connected (e.g., by hard-wiring, remote control, or other known means) to valves and/or pump devices (e.g., 24, 26, 28, etc.) and metering devices (e.g., 34, 36, 38, etc.) so that the separate amounts and/or rates of admixture raw materials dispensed from the transport tanks (14–22) can be monitored or tracked. For example, a customer profile or pre-order information can be stored in computer memory (designated as at 72) and accessed by the CPU 70 which can send appropriate signals to the pumps (24–32) and metering devices (34–42) so as to have the appropriate amounts of admixture raw materials introduced into the blender 50 and/or directly into the customer's holding tank 60. The CPU may also be connected to metering devices for controlling the amount of water, preferably sourced at the customer site 88, drawn into the blender 50 or, if need be, into any of the individual transport tanks (14).

In preferred processes and systems of the invention, the customer profile information can be transcribed as a bar code 62 that can be affixed to the customer's holding tank 60. Thus, the vehicle 12 operator can scan the bar code 62 into the CPU 70, which then accesses the corresponding customer profile and/or account information (stored in memory 72) and sends the appropriate signals to the appropriate valves/pumps 24–32 and/or metering devices 34–42. If the transport tanks do not contain the correct admixture or sufficient amounts of a desired admixture raw material, admixture, or admixture blend, the CPU 70 can trigger an audible and/or visual alarm to the operator, who will need to make adjustments or otherwise confirm the situation before proceeding to deliver the admixture product.

The CPU 70 is preferably connected to the quality control units to obtain indications from the total solids measuring device 52, pH measuring device 54, viscosity measuring device 56, and/or specific gravity measuring device 58 and provide visual indications on a monitor. The CPU 70 can be programmed to signal an alarm if the quality control units provide a signal that indicates that one or more of the physical characteristics of the customer's profile 72 or specifications are not being met; and the CPU can be programmed to send signals to the appropriate admixture valve/pump (e.g., 24–32) or metering device (34–42) to shut off or increase the flow of a particular admixture raw material 14-22 and correct the situation. The quality control units 52/54/56/58 are preferably located on the vehicular frame 12, and may be removable therefrom, if desired, so that they can be used to test the contents of the customer holding tank 60 as well.

In further exemplary systems and processes of the invention, the transport holding tanks (e.g., 14, 16, etc.) have volume sensing means which provide an indication of the volume of admixture raw material in a transport tank or may provide a signal to the CPU 70 corresponding to tank volume. Thus, the CPU 70 may provide an indication, such as through a print-out or monitor display (not schematically illustrated) to the operator or driver of the admixture delivery vehicle 10/12 regarding the admixture raw material levels in each of the tanks (e.g., 14, 16, etc.).

In further exemplary processes and systems of the invention, therefore, a vehicle operator may determine, such as before or after a given delivery assignment, whether the vehicle has particular raw materials for satisfying the next customer's profile. For example, after a first delivery at a customer's site, an operator can ascertain whether current on-board inventory will be sufficient to meet the next delivery at that same site, or another customer's profile at another site. Such information may be stored 72 on the vehicle 12 or even obtained by transmission from a central dispatching office at another location. Alternatively, the CPU 70 can provide readings of current raw materials inventory on board the vehicle, and enable to the operator to determine which next customer orders can be filled with current inventory, facilitating the ability of the operator to choose which of the next customer sites should be targeted for filling orders.

The process for filling a customer order may proceed, for example, by using the CPU (e.g., laptop) to calculate the batch size and confirm the raw admixture material quantities on board, and provide an indication as to how much water is required. The operator can then fill an on-board water holding tank 86 or otherwise confirm, through sensing means in the tank 86, that sufficient water is at hand. After unblocking valves and connecting the appropriate hoses, the operator uses the CPU to initiate the admixture manufacturing process. A set of instructions can be provided to the CPU either inputted directly or from the customer profile data storage 72 (which may be initiated by scanning the bar code 62), whereby a number of operations are inititated and monitored: such as the opening and closing of valves and/or the operation/speed of pumps; the flow rate of all raw materials: the total flow of the raw material or final admixture product into the holding tank 60; and any or all quality control functions (e.g., 52, 54, 56, 58) are also initiated and monitored.

In still further exemplary systems and processes of the invention, the CPU 70 is programmed with logic to permit step change addition (or decrease rate addition) of raw admixture components from any of the transport tanks 14/16/18/20/22 to meet end specifications. The CPU 70 can also be programmed to close valves, shut pumps, and/or provide visual and/or audible alarms if a desired condition (e.g., a quality control characteristic such as total solids, pH, viscosity, specific gravity, etc.) is not being met. Safety kill-switches can be installed near the laptop or hand-held control unit (e.g., 70) or at the end of the dispensing hose 59 to shut down the system 10 during an emergency or alarm.

After a successful delivery, the operator can use the system 10 to confirm raw admixture material remaining in the transport tanks (14,16, etc.). This can be displayed using the CPU 70 and conventional monitor or printer devices (not shown). Accounting software 74 can be implemented in preferred systems and processes to keep track of the identity and amount of individual admixture raw materials or admixture blends that may be contained in the transport tanks (e.g., 14, 16, etc.) required to fill an order, and the operator can provide an invoice or meter ticket which incorporates this information at the time of delivery. The meter ticket can be signed by the customer as a record of the delivery.

Still further exemplary systems 10 and processes of the invention incorporate the use of cellular communications to permit, for example, data and information concerning current admixture inventory, customer profiles, delivery routes, meter ticket information, confirmations of delivery, and other information to be shared with other such systems 10 or even with a sales office, so that national or regional information (such as pertaining to customer orders, profiles, usage, problems if any) can be stored, transmitted, monitored, gathered, and/or analyzed. The system permits the operator to determine what admixture formulation products can be produced with the remaining on-board inventory, and can confirm if next delivery is possible. The operator can then drive to the next customer site and repeat the process.

As modifications of the invention may be evident to those of ordinary skill in the art in view of the disclosure herein, the scope of the invention is not intended to be limited by the foregoing examples.

We claim:

1. A process for manufacturing concrete admixture products comprising: providing in separate transport tanks mounted on a vehicular frame at least two admixture raw materials; transporting said at least two admixture raw materials; blending together said at least two raw materials to form a finished admixture product; subjecting blended material to a quality control unit operative for measuring at least one physical quality of said blended material; and dispensing a finished admixture product.

2. The process of claim 1 further comprising: providing valve means or pump means for controlling the flow of raw materials or admixtures into a blender mounted on said vehicular frame.

3. The process of claim 2 further comprising: providing metering means for metering raw material from said transport tanks into said blender.

4. The process of claim 1 further comprising: metering water into said blender and combining said water with raw material therein.

5. The process of claim 4 wherein said water is sourced at a customer site.

6. The process of claim 1 wherein said quality control unit is mounted on said vehicular frame.

7. The process of claim 5 wherein a physical property comprises total solids, pH, viscosity, or specific gravity.

8. The process of claim 1 further comprising: dispensing the finished admixture product into a holding tank located at a customer site.

9. The process of claim 8 wherein, after blending together raw materials and dispensing a finished admixture product at the customer site, a different combination of raw materials is blended to provide a different finished admixture product at the customer site.

10. The process of claim 1 further comprising: providing metering means for controlling the rate at which said raw materials are fed from said transport tanks; and providing a central process unit connected to said metering means, whereby the rate at which said raw materials are fed from said transport tanks can be controlled.

11. The process of claim 1 wherein each of said at least two raw admixture materials, when combined with water or another raw material, are operative to provide a finished admixture product comprising an accelerator, set retarder, air detrainer, air entrainer, alkali-activity reducer, bonding admixtures, water-reducing admixture, superplasticizer, colorant, corrosion inhibitor, damp proofing admixture, gas-forming agent, permeability reducer, pumping aid, biocidal admixture, or mixture thereof.

12. The process of claim 1 wherein said transport tanks have volume sensing means.

13. The process of claim 1 wherein said vehicular frame is a truck, trailer, or other mobile platform structure having wheels.

14. A mobile concrete admixture manufacturing system comprising a plurality of separate transport tanks mounted on a vehicular frame and containing in said tanks at least two different admixture raw materials; said system further comprising a blender for mixing together said at least two raw materials, pumping means for feeding raw material from said transport tanks to said blender, metering means for metering said raw materials provided into said blender, and at least one quality control unit for measuring a physical quality of a raw materials or finished admixture product to be dispensed from said mobile system.

15. The system of claim 14 further comprising a central processing unit electronically connected to said pumping means, metering means, and said at least one quality control unit.

16. The process of claim 15 further comprising an alarm operative to signal an operator if said at least one quality control unit detects that a physical characteristic of the customer profile data is not being met.

17. The system of claim 15 wherein said central processor unit, in response to a signal from said at least one quality control unit, is operative to shut off or increase the flow of a particular admixture raw material.

18. The system of claim 15 wherein transport tanks have volume sensing means operative to provide a signal to said central processor unit, and said central processor unit is operative to provide an indication, through a print-out or monitor display, to the operator regarding admixture raw material levels in the tanks.

19. The system of claim 15 wherein said vehicular frame is a truck, trailer, or other mobile platform structure having wheels.

20. The system of claim 14 further comprising metering means for metering the amount or rate of water desired to be introduced into said blender.

21. The system of claim 14 wherein said at least one quality control unit is operative for measuring total solids, viscosity, specific gravity, pH, or volume of concrete admixture being dispensed from said system.

22. The system of claim 19 wherein each of said at least two raw admixture materials, when combined with water or another raw material, are operative to provide a finished admixture product comprising an accelerator, set retarder, air detrainer, air entrainer, alkali-activity reducer, bonding admixtures, water-reducing admixture, superplasticizer, colorant, corrosion inhibitor, damp proofing admixture, gas-forming agent, permeability reducer, pumping aid, biocidal admixture, or mixture thereof.

23. The system of claim 14 wherein said raw materials comprise a material selected from molasses, sulfonates, calcium chloride, amines and alkanolamines, tall oil fatty acids, fatty acids and their derivatives, fatty esters and their derivatives, sodium gluconate, dyes, formic acid, sucrose, sugars, glucose, sodium nitrite, sodium nitrate, calcium nitrite, calcium nitrate, calcium bromide, corn syrup, sodium sarcosinate, calcium lignosulfonate, lignin, alcohols, glycols, glycerols, acetic acid, anhydrous caustic soda, sodium hydroxide, potassium hydroxide, sodium linear alkylate sulfonate, formaldehyde, silica, a diglycinate, polymers containing oxyalkylene, calcium formate, formic acid, siloxanes, surfactants, resins and resin acids, or mixtures thereof.

24. A process for manufacturing finished admixture product at a customer site comprising:

providing in a plurality of separate transport tanks mounted on a vehicular frame different admixture raw materials;

providing at least one blender mounted on said vehicular frame for mixing together at least two of said different raw materials;

providing metering means for measuring the amount or rate of said raw materials provided from some of said separate transport tanks to said at least one blender;

blending said raw materials to provide a finished admixture product to be dispensed into a customer site holding tank;

providing at least one quality control unit to measure at least one physical quality of the finished admixture product;

dispensing said finished admixture product into a customer site holding tank; and said process further comprising providing a central processor unit electronically connected to said metering means; inputting customer profile data into said central processor unit; and metering raw materials into said blender in accordance with said data input.

25. The process of claim 24 further comprising the step of subjecting finished admixture product to be dispensed to at least one quality control unit and measuring a physical quality of the finished admixture product.

26. The process of claim 25 further comprising providing an alarm operative to signal an operator if said at least one quality control unit detects that a physical characteristic of the customer profile data is not being met.

27. The process of claim 25 wherein said central processor unit, in response to a signal from said at least one quality control unit, is operative to shut off or increase the flow of a particular admixture raw material.

28. The process of claim 24 wherein each of said at least two raw admixture materials, when combined with water or another raw material, are operative to provide a finished admixture product comprising an accelerator, set retarder, air detrainer, air entrainer, alkali-activity reducer, bonding admixtures, water-reducing admixture, superplasticizer, colorant, corrosion inhibitor, damp proofing admixture, gas-forming agent, permeability reducer, pumping aid, biocidal admixture, or mixture thereof.

29. The process of claim 24 wherein said transport tanks have volume sensing means operative to provide a signal to said central processor unit, and said central processor unit is operative to provide an indication, through a print-out or monitor display, to the operator regarding admixture raw material levels in the tanks.

30. The process of claim 24 further comprising transmitting customer profile information from a central dispatching office at another location to said central processor unit.

31. The process of claim 24 wherein said vehicular frame is a truck, trailer, or other mobile platform structure having wheels.

32. The process of claim 24 wherein said raw materials comprise a material selected from molasses, sulfonates, calcium chloride, amines and alkanolamines, tall oil fatty acids, fatty acids and their derivatives, fatty esters and their derivatives, sodium gluconate, dyes, formic acid, sucrose, sugars, glucose, sodium nitrite, sodium nitrate, calcium nitrite, calcium nitrate, calcium bromide, corn syrup, sodium sarcosinate, calcium lignosulfonate, lignin, alcohols, glycols, glycerols, acetic acid, anhydrous caustic soda, sodium hydroxide, potassium hydroxide, sodium linear alkylate sulfonate, formaldehyde, silica, a diglycinate, polymers containing oxyalkylene, calcium formate, formic acid, siloxanes, surfactants, resins and resin acids, or mixtures thereof.

* * * * *